United States Patent [19]

Manske et al.

[11] Patent Number: 4,898,263

[45] Date of Patent: Feb. 6, 1990

[54] ELEVATOR SELF-DIAGNOSTIC CONTROL SYSTEM

[75] Inventors: Bradley W. Manske, Moline; John M. Weber, Milan, both of Ill.

[73] Assignee: Montgomery Elevator Company, Moline, Ill.

[21] Appl. No.: 243,416

[22] Filed: Sep. 12, 1988

[51] Int. Cl.[4] ..... B66B 3/00

[52] U.S. Cl. ..... 187/133; 187/101

[58] Field of Search ..... 187/101, 124, 132, 133, 187/130

[56] References Cited

U.S. PATENT DOCUMENTS

| | | | |
|---|---|---|---|
| 4,397,377 | 8/1983 | Husson et al. | 187/101 X |
| 4,491,198 | 1/1985 | Noda et al. | 187/130 |
| 4,681,190 | 7/1987 | Toshiaki | 187/101 |
| 4,698,780 | 10/1987 | Mandel et al. | 187/130 X |
| 4,771,865 | 9/1988 | Hinderling | 187/130 |
| 4,823,914 | 4/1989 | McKinney et al. | 187/133 |

*Primary Examiner*—A. D. Pellinen
*Assistant Examiner*—W. E. Duncanson, Jr.
*Attorney, Agent, or Firm*—Wood, Dalton, Phillips Mason & Rowe

[57] ABSTRACT

An elevator self-diagnostic system monitors the operative status of various elevator components and upon sensing an error initiates action to bring the elevator car to a safe operating state. The system then logs the error. The diagnostic system then analyzes the error and the conditions prevailing at the time the error occurred and, if necessary, a corrective action is then taken to resolve the error. This allows the elevator system to be brought back into service more quickly than would otherwise be possible. Specifically, a number of tests are serially performed on various elevator components, such as the motor drive, the position sensors, etc. When an error, or fault, arises in a system component, a selt-diagnostic system logs a preselected error level which has been assigned to the particular fault. A preselected action is then taken according to the particular error. For example, if the output of the position encoder is lost while the elevator car is running, then the elevator car's velocity is decreased at a constant rate until the car is brought to a stop. A short time later, the car is restarted and proceeds toward its target floor.

13 Claims, 15 Drawing Sheets

ELEVATOR SELF-DIAGNOSTIC CONTROL SYSTEM

DESCRIPTION

1. Field of the Invention

The present invention relates generally to elevator systems, and more particularly to a system and method for diagnosing elevator operational errors and taking a preselected action responsive thereto.

2. Background of the Invention

Prior elevator control systems have included safety circuits which sense potentially unsafe elevator operational conditions. In the event that an error occurs, such a safety circuit operates to stop car movement, either virtually immediately or by slowing to a stop.

Although such prior elevator safety circuits provide for safe operation, the action taken may be unnecessary depending upon the particular error. Some errors may be of a minor nature, not requiring the car movement to be stopped. Such unnecessary stopping may be an inconvenience to passengers.

Certain operational failures, such as the failure of a backup system, required that the elevator be shutdown until the backup system is repaired. Otherwise, the backup system failure could go undetected for long periods of time.

Also, with such prior safety circuits, it was often difficult to diagnose errors. Once an error occurred, it was necessary to evaluate the condition of the circuitry to determine the exact cause of the error without the benefit of knowing the operational conditions prevailing at the time the error occurred. Accordingly, elevator technicians had a more difficult time in attempting to resolve the problems which existed.

The present invention is intended to overcome these and other problems associated with elevator systems.

SUMMARY OF THE INVENTION

In accordance with the present invention, a control for an elevator system according to the present invention is provided with a diagnostic system for implementing a desired action according to the level of an elevator operational error.

Broadly, there is disclosed herein an elevator control system which is operable to control movement of an elevator car in a hoistway. The control system includes a diagnostic system including means for sensing the operative status of a plurality of preselected elevator operational characteristics. Each of the operational characteristics has a preselected error level. Means are coupled to the sensing means for monitoring the operative status of the characteristics to determine if any of the operational characteristics are in an error status. Means are included responsive to the monitoring means for operating the control system to implement a preselected desired action according to the error level of any operational characteristic which is in an error status as determined by the monitoring means.

More specifically, an elevator self-diagnostic system monitors the operative status of various elevator components and initiates some action to provide for safe operation. A corrective action may then be implemented so that operational errors in the system can be accounted for and corrected, if possible. This in turn allows the elevator system to be brought back into service more quickly than would otherwise be possible. Specifically, a number of tests are serially performed on various elevator components, such as the motor drive, the position sensors, etc. When an error arises in a system component, a self-diagnostic system first selects an appropriate response action to seek a safe operating state and then logs a preselected error code which has been assigned to the particular error. The diagnostic system then analyzes the error and the conditions prevailing at the time the error occurred and, if necessary, a corrective action is then taken to resolve the error. The corrective action may involve exercising the system to facilitate analysis. For example, if the output of the position encoder is lost while the elevator car is running, then the elevator car's velocity is decreased at a constant rate until the car is brought to a stop. A short time later, the car is restarted and an attempt is made to determine its position while moving at a slow speed. If this is accomplished successfully, then the car proceeds toward its target floor. The diagnostic system also records the error code and the prevailing conditions for later use by a service technician.

The self-diagnostic system is operable to perform other types of action depending upon the nature of the error including an emergency or panic stop which shuts down the motor and sets the brake, a slowdown to a slower speed during which the elevator car proceeds at a slower speed to the uppermost or lowermost floor, a normal stop at the next available floor, and simply logging of the error without other action.

Further features and advantages of the invention will readily be apparent from the specification and the drawings.

Figure 2:
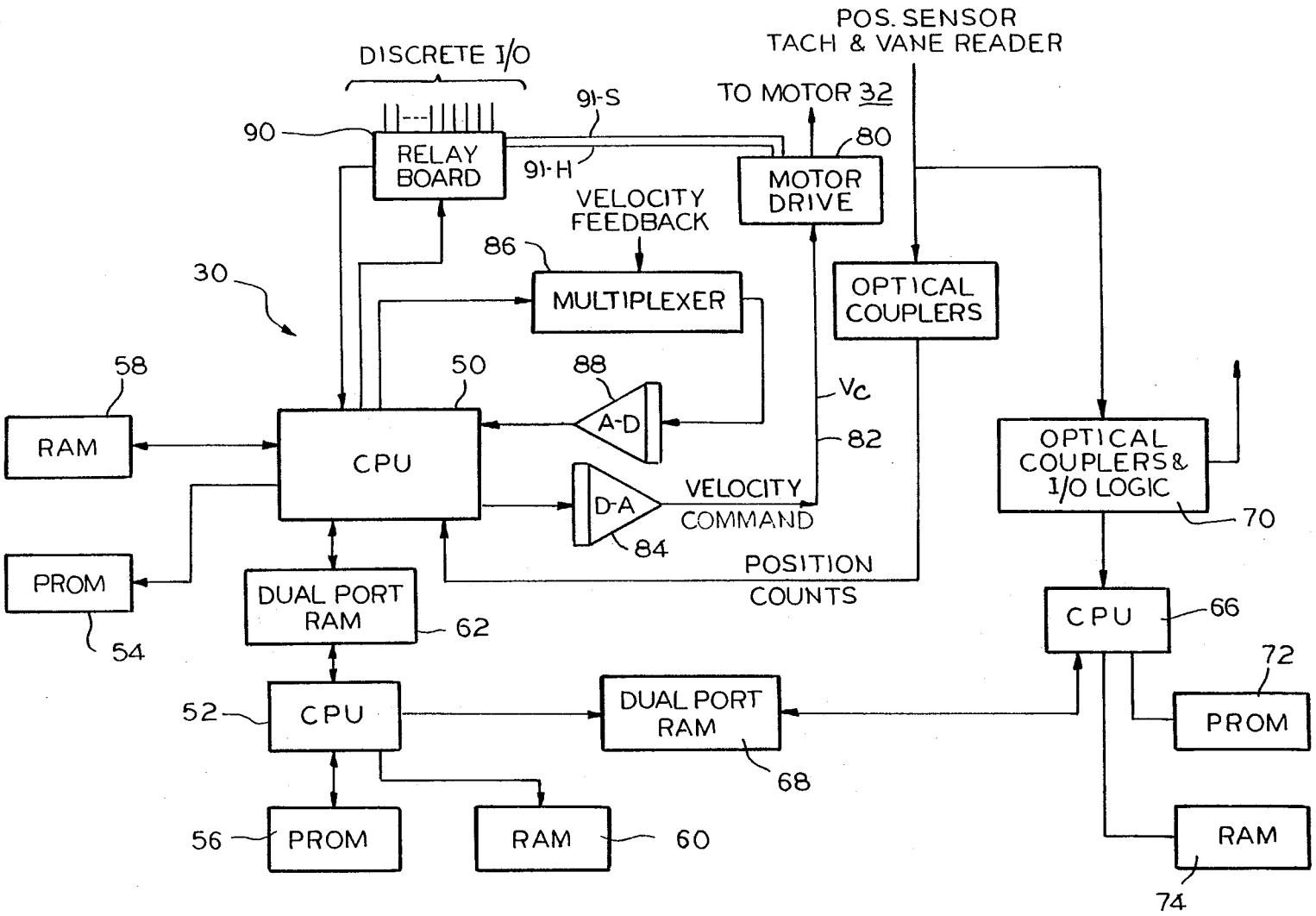
FIG. 2 is a block diagram of the control system illustrated in FIG. 1.
Figure 6:
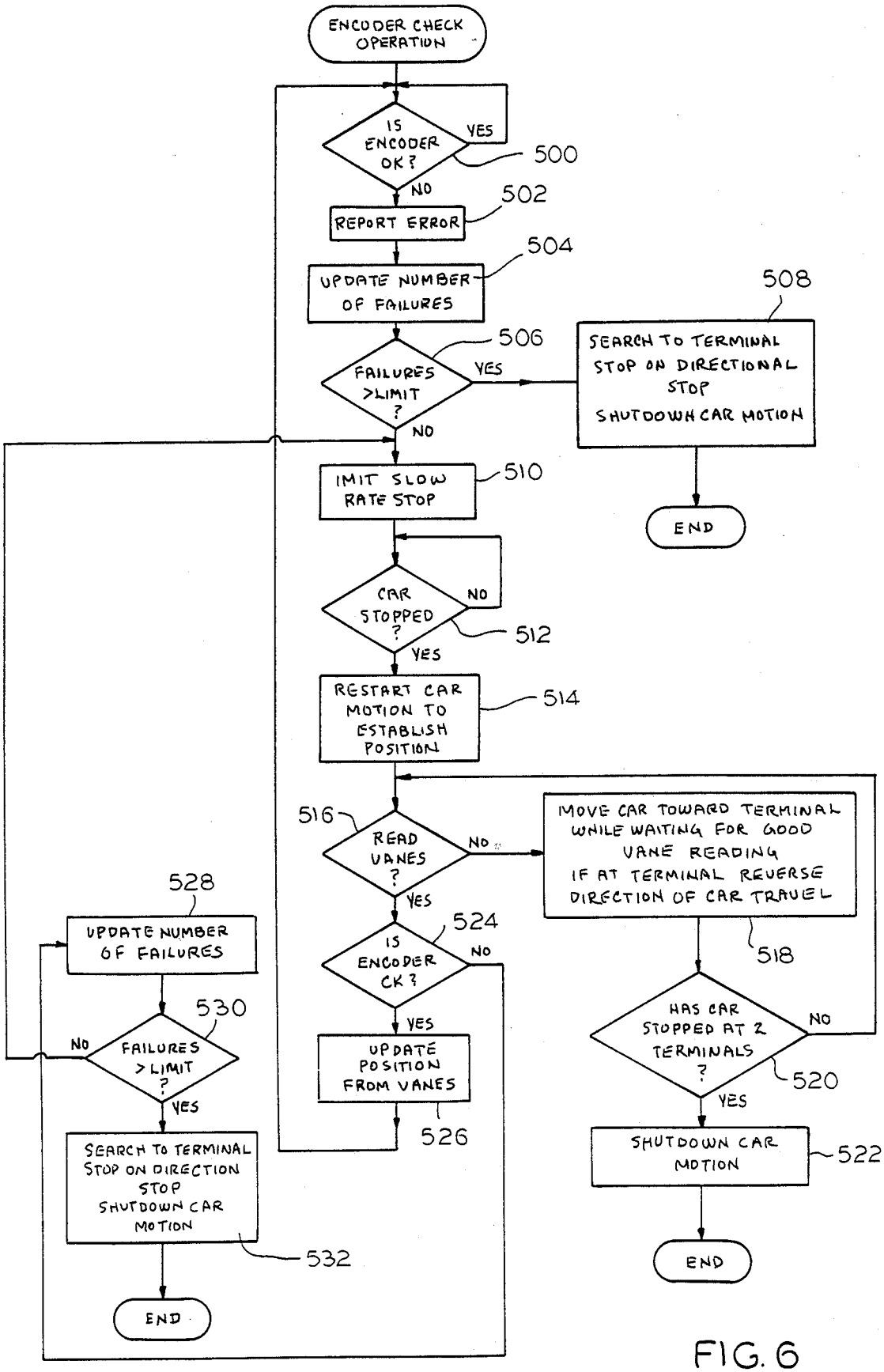
Figure 7:
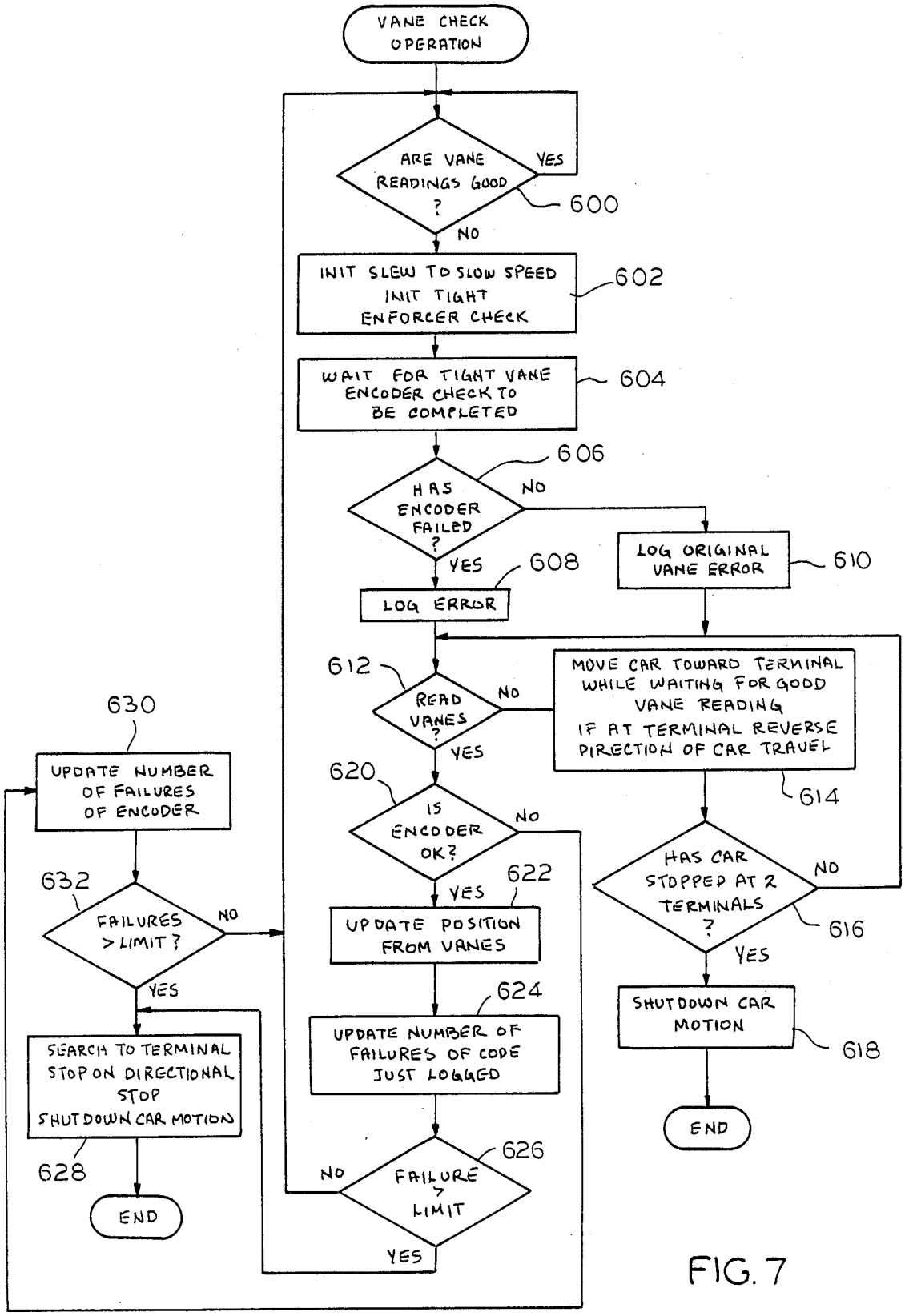

FIGS. *4a–4e* comprise a flow chart of a safety check program executed by the CPU 52 illustrated in FIG. 2 to determine if any corrective action needs to be taken;

FIGS. *5a–5d* comprise a flow chart of an execute safety level program executed by the CPU 52 illustrated in FIG. 2 to implement a desired corrective action;

FIG. 6 comprises a flow chart of an encoder check operation;

FIG. 7 comprises a flow chart of a vane check operation; and

Figure 8:
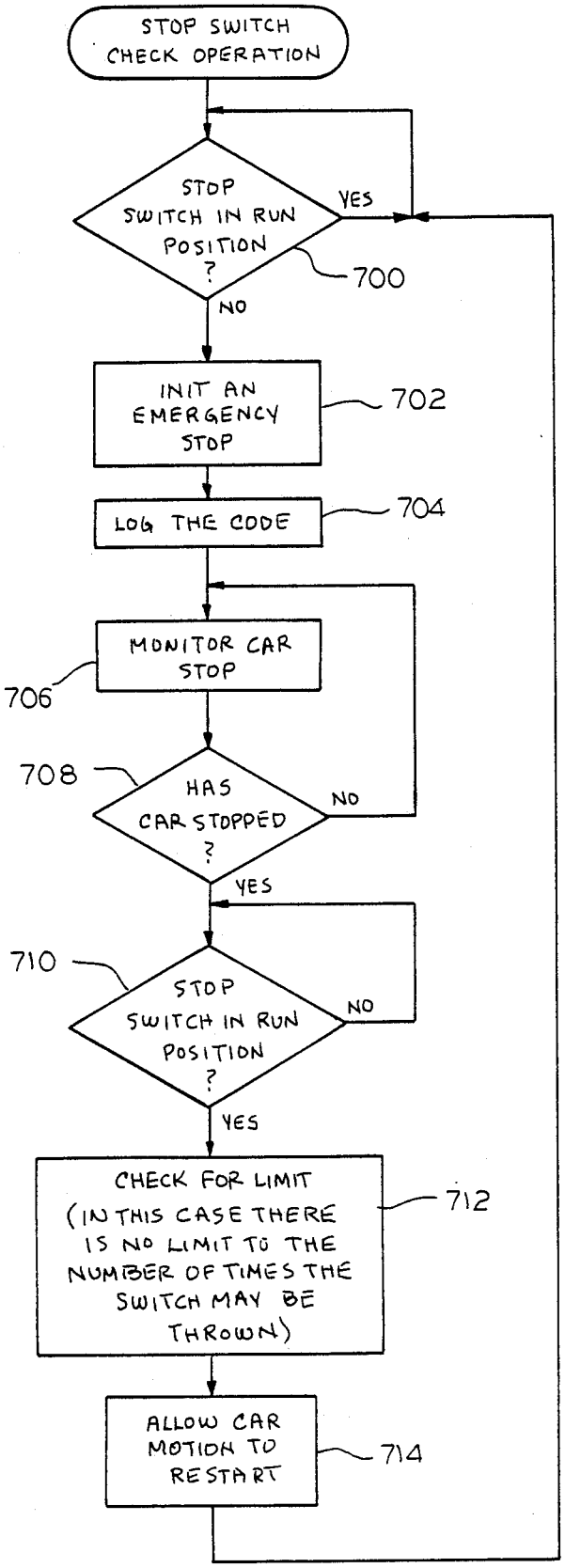

FIG. 8 comprises a flow chart of a stop switch check operation.

DESCRIPTION OF THE INVENTION

Figure 1:
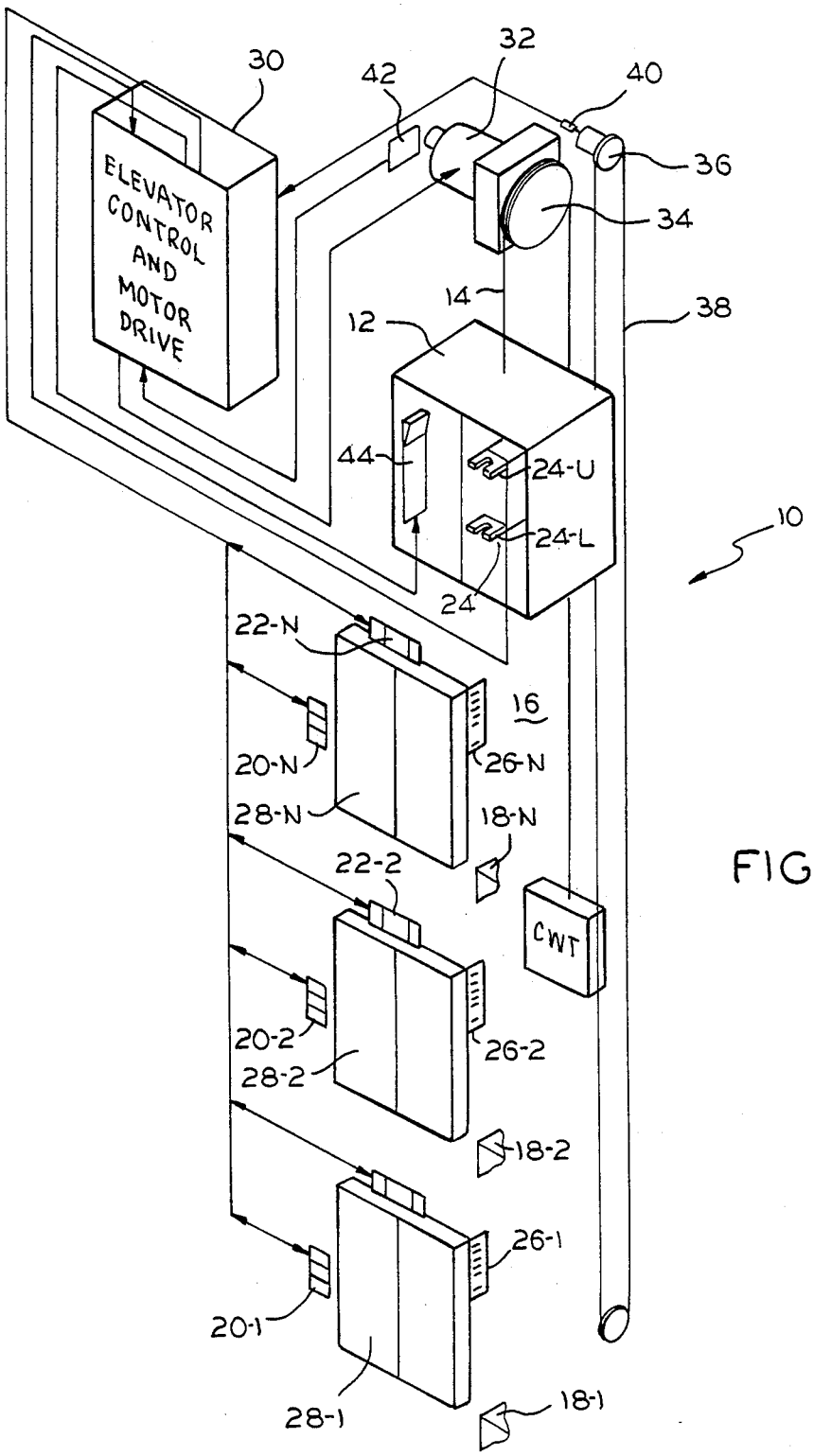
FIG. 1 is a block diagram of an elevator system including a self-diagnostic control system according to the present invention.

Referring first to FIG. 1, an elevator system 10 includes an elevator car 12 suspended by a cable 14 in a hoistway 16. The elevator car serves a plurality of landings or floors, 18-1, 18-2 . . . 18-n. Disposed at each floor 18-1 through 18-n is a respective call station 20-1, 20-2 . . . 20-n, at which a user may request elevator service and at which an acknowledgement of a request for elevator services is displayed. In addition, position indicators (PI's) 22-1, 22-2 . . . 22-n may be provided at the respective floors 18-1, 18-2 . . . 18-n, to indicate the position of the car 12 within the hoistway 16.

The elevator car 12 carries a vane reader 24 which reads encoded vanes 26-1, 26-2 . . . 26-n disposed adjacent hall doors 28-1, 28-2 . . . 28-n, respectively. The vane reader 24 provides position information to an elevator control and motor drive unit 30 which may be disposed in a machine room or other location remote from the elevator car 12. The elevator control and motor drive unit 30 controls a motor 32 which in turn rotates a sheave 34 over which the cable 14 extends so as to control the movement of the elevator car 12 in the hoistway 16. A speed governor 36 is attached by a further cable 38 to the elevator car 12. The governor 36 prevents the elevator car 12 from reaching an overspeed condition. A position sensor, or encoder, 40 detects rotation of the governor 36 and provides additional car position information to the elevator control and motor drive unit 30. The unit 30 controls a car position indicator (PI) 44 disposed in the elevator car 12 which displays the current position and direction of movement of the car 12. The unit 30 also receives signals developed by a tachometer 42 representing the speed of the motor 32.

Referring to FIG. 2, there is illustrated in block diagram form the elevator control and motor drive unit 30 shown in FIG. 1. The unit 30 includes a first central processing unit (CPU) 50 and a second CPU 52. The first CPU 50 executes various programs according to instructions stored in a programmable read-only memory (PROM) 54 which program is essentially independent of the specific elevator installation. The CPU 52, on the other hand, executes programs according to instructions stored in a PROM 56 which is specific to the particular elevator installation. The programming in the PROM 56 takes into account, for example, the number of floors serviced by the elevator 12, the distance between floors or landings 18, the speed at which the elevator car 12 travels through the hoistway 16, etc.

The CPU's 50 and 52 are also coupled to and utilize random access memories (RAM's) 58 and 60, respectively. The first CPU 50 and the second CPU 52 communicate with one another via a dual port RAM 62 which permits either CPU to read or write information from any storage location therein. In the event the CPU's 50 and 52 issue simultaneous write requests to the same storage location, the dual port RAM 62 arbitrates between the requests to determine which controls.

The CPU 52 also communicates with a third CPU 66 through a dual port RAM 68 which is identical to the RAM 62 described above. The third CPU 66 communicates with the hall and car call stations PI's 22-1 through 22-n, and 44 via optical couplers and input/output (I/O) logic circuits 70. The third CPU 66 executes programs according to instructions stored in a PROM 72 and is further coupled to a RAM 74.

The third CPU 66 manages the transfer of input/output data to/from the elevator control unit 30 while the first CPU 50 controls the motor 32 via a motor drive 80 in response to velocity profile data developed by the CPU 52. More specifically, the first CPU 50 develops a digital velocity command which is converted into an analog signal $V_c$ on a line 82 by a digital to analog (D/A) converter 84. This first CPU 50 also receives a velocity feedback signal from the tachometer 42 via a multiplexer 86, controlled by the CPU 50, and an analog to digital (A/D) converter 88. The first CPU 50 operates in a closed loop mode to control the velocity of the elevator car in the hoistway 16.

The first CPU 50 also communicates with a relay interface board 90. The relay interface board 90 includes interface logic for connecting discrete input/output devices to the first CPU 50. Such discrete devices may be input devices which sense, for example, an "on" or "off" state of switches and the like, or controllable devices which may be controlled in an "on" or "off" state, as described more specifically below. The relay board receives hard and soft fault indications from the motor drive 80 as represented by the respective lines 91S and 91H.

Figure 3:
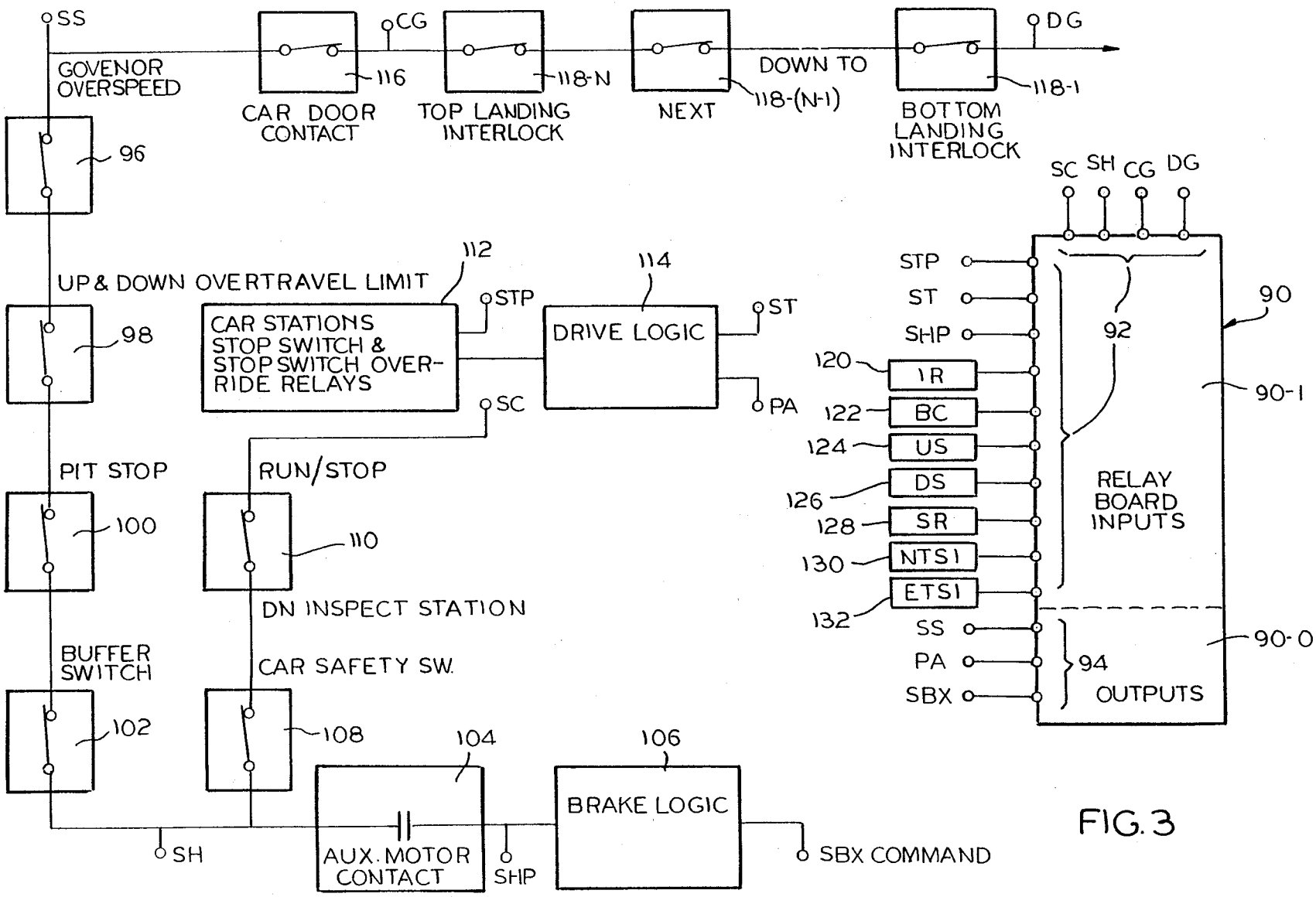
FIG. 3 is a block diagram of a sensing and monitoring circuit of the control system of FIG. 1.

Referring to FIG. 3, there is illustrated a schematic diagram representing the connection of other discrete input and output devices to the relay interface board 90. The relay interface board 90 includes conventional input interface circuits, generally designated 90-I, having terminals 92 for connecting to input devices. Similarly, the relay board 90 includes conventional output interface circuits, generally designated 90-O, including terminals 94 for connecting to various discrete output devices.

The relay board 90 is used to monitor the operational status of various elevator components. In most cases external switches or other devices sense particular elevator operations and provide, for example, a contact closure or opening if an operational error exists.

One output terminal 94 is connected to a safety string terminal SS. The safety string terminal SS is connected through a series of contacts all of which must be closed in order for the elevator car to run. Particularly, the SS terminal is connected through a series of normally closed contacts of a governor overspeed switch 96, an up and down overtravel limit switch 98, a pit stop switch 100, and a buffer switch 102 to an input terminal 92 designated SH. The safety string is further connected through a series auxiliary motor starter normally open contact 104 to an input terminal 92 designated SHP, and to a brake logic circuit 106. Also series connected to the safety string are the normally closed contacts of a car safety switch 108 and a run/stop switch 110 to an input terminal 92 designated SC. The safety string also is coupled through a plurality of car station stop switches and override switches represented by a block 112 to an input terminal 92 designated STP, and further through a drive logic circuit 114 to an input terminal 92 designated ST.

The SS output terminal is also connected through a normally closed contact of a car door limit switch 116 to an input terminal 92 designated CG, and further through a series comprising contacts for a top landing interlock switch 118-N and through similar landing interlock switches 118 for each floor, to a bottom landing interlock switch 118-1 and to an input terminal 92 designated DG.

The car door switch 116 is operable to sense whether a door for the elevator car 12 is in the open or closed position. The landing interlock switches 118 provide an indication whether the car doors 28 at each floor are in an open or closed position. Particularly, the elevator car 12 should not be operated if any of these doors are in an open position.

Also connected to additional input terminals 92 are conventional elevator systems such as an inspection block 120, a balance complete block 122, an upstop block 124, a downstop block 126, a brake status block 128, a normal terminal stop indicator block 130, and an emergency terminal stop indicator block 132, all discussed in greater detail below. Also, output terminals 94 are connected to a terminal designated PA for a drive logic block 114 which is part of the drive 80, and to a terminal SBX of the brake logic block 106. The PA output is used to command the drive logic 114 to apply power to the motor and to follow the velocity command from the first CPU 50, see FIG. 2. The SBX output is used to command the brake logic 106 to apply power to the brake to release the brake. With the brake released the car is allowed to run.

During normal operation, the first CPU 50 periodically monitors the status of the discrete input devices connected to the relay interface board 90 and the velocity position information, discussed above. To monitor the discrete input devices in the safety string, the output terminal 94 connected to the SS terminal is continuously energized, while the input terminals coupled thereto through selected contacts are periodically monitored to determine the operational status. Similarly, the first CPU 50 periodically updates the output devices, such as the velocity command to the motor drive and the discrete output devices. The status and output information is received through the dual port RAM 62 by the second CPU 52 which performs and implements the overall control program.

Specifically, the second CPU 52 executes a diagnostics cycle every 1/60th of a second, and performs multiple tasks within each cycle, as necessary. The principal task is a motion control task which operates to control movement of the elevator car 12. Other tasks may run in each cycle if time remains.

Referring to FIGS. *4a–4f*, a flow diagram representation of a safety check task is illustrated. The safety check task is operable to monitor the operational status of various elevator components as determined by sensing devices, discussed above, and to assign a preselected error log code and a preselected action level responsive to any component being in an error condition. The code is used to designate the specific nature of the error, while the level indicates the severity of the error and designates what action should be taken. The action level may be any one of six defined as follows:

Action level 1: Emergency stop. An emergency stop is generally initiated automatically by the motor drive 80, as is well known, and the program monitors the cause. Alternatively, the stop may be initiated by the program. This action involves shutting down the motor 32 and setting the brake immediately.

Action level 2: Constant deceleration to stop. The car 12 is usually slowed to a stop by the motor drive 80 independently of the program, but this may be initiated by the program. The program monitors the cause.

Action level 3: Constant deceleration to slow speed. The car 12 continues to the destination at a slower speed and stops only when the car is commanded to switch direction at a terminal.

Action level 4: Normal stop at next available floor under normal control.

Action level 5: Record error only. No other action is taken.

Action level 6: This is a default or reset level which is used when no error exists, or if the car is not running after an error has occurred.

As is conventional, the flow chart includes rectangular shaped blocks for indicating if a specific action is taken in the control operation. Diamond shaped blocks, referred to herein as decision blocks, are provided with a question which has a yes or no answer, with the resulting control direction being determined by the answer. Logic blocks are rectangular shaped blocks having rounded corners which perform an "if . . . , then . . . " control function as indicated within the block. Specifically, if the condition of the initial phrase is true, then the action indicated in the parentheses is implemented. If the condition of the initial phrase is false, then the action in parentheses is ignored.

The safety check task is first described as if it is being executed for the first time during elevator operation, i.e., no error condition exists and the level value is six.

The safety check task begins at a decision block 200 which determines whether a "safety level" register contains a value greater than two. The safety level register stores the level number of the most severe error which has occurred during the particular run, or the reset value six. On the first pass through the routine, the safety level value is greater than two, and therefore, a decision block 202 determines whether or not the elevator car 12 is running. The car 12 is considered running if the brake is released. If the car 12 is running, then a gross encoder check is performed with a routine 204. Specifically, a decision block 206 determines whether the velocity as determined by the tachometer 42 is greater than a preselected value W feet per minute. If so, then a logic block 208 is responsive to the input from the encoder 40 and monitors the actual direction as compared to the intended direction. This test is intended to ensure that the encoder is functional at speeds over W feet per minute. Preferably, the logic block 208 operates after several consecutive failures are detected, and calls an "execute safety level" routine, assigning an error code of 01 and a level of 2. The execute safety level routine is described in greater detail below relative to FIGS. *5a–5e* and performs the desired action.

Thereafter, or if the velocity is not greater than W feet per minute, as determined at the decision block 206, then a logic block 210 determines if a vane failure has occured, and if so, calls a tight encoder check routine. Particularly, the system determines if a vane 26 was improperly read during a previous cycle of operation, as discussed more specifically below. The tight encoder check routine slows the car down to approximately W feet per minute and holds it for several seconds and counts the input pulses from the encoder 40. The number of counts is compared to an expected range to ensure that it is accurate.

A logic block 212 determines if the ETSI system 132 is operating. The ETSI system 132 is a backup for the NTSI system 130 and provides for an emergency terminal stop when the NTSI system 130 has failed, as is well known, and is assigned a code of 02 and a level of 2.

Thereafter, control advances via a node C to a vane reader check routine 214, see FIG. *4b*. A decision block 216 determines whether or not the car 12 is decelerating to a stop as commanded by the first CPU 50. Specifically, a different check must be performed according to whether the car is running, or is stopped or stopping. If the car 12 is running, then a decision block 218 determines whether or not the car 12 is greater than X inches from the closest floor landing 18. X is a preselected value representing the maximum distance of the car 12 from a floor 18 that a vane 26 can be sensed by the vane reader 24. If not, then no check is performed and the routine 214 ends. If the car 12 is more than X inches from the landing 18, then a decision block 220 determines whether or not the light beam from either sensor of the vane reader 24 is broken. Particularly, the vane reader 24 includes an upper photoelectric sensor 24-U and a lower photoelectric sensor 24-L. When the car 12 is more than X inches from a landing 18, then the vane reader 24 should be remote from the vane 26 and the beams should not be broken. If this is the case, then the vane reader 24 is operational and the routine ends. If one of the beams is broken, as determined at the decision block 220, then a logic block 222 determines if the beam from the top reader 24-U is broken. If so, then the execute safety level routine is called designating code 03 and level 3. Similarly, a logic block 224 determines if the beam from the bottom reader 24-L is broken, and if so calls the execute safety level routine designating code 04 and level 3. Thereafter, the vane reader check routine 214 ends.

If the car is stopped or stopping as determined at the decision block 216, then a decision block 226 determines whether or not the car 12 is less than Y inches from the landing 18. Y is a preselected low value indicating that the car 12 is at or near the landing 18. If not, then the vane reader check routine 214 ends. If so, then a decision block 228 determines if the light beams from both vane readers 24-U and 24-L are broken. Under normal conditions, if the car 12 is less than Y inches from the landing 18, then both readers should be broken. If so, then the vane reader check routine 214 ends. If the beams from both readers are not broken, as determined at the decision block 228, then the logic block 230 determines if the beam is being sensed by the top reader 24-U, and if so then it calls the execute safety level routine designating code 05 and level 4. Then, a logic block 232 determines if the beam is completed across the bottom reader 24-L and if so calls the execute safety level routine designating code 06 and level 4. Thereafter, the vane reader check routine 214 ends.

Subsequent to the vane reader check routine 214, control advances to a performance comparator check routine 234. The performance comparator check routine 234 operates to compare the actual velocity as sensed by the tachometer 42 with desired velocity as determined by the motion task.

A decision block 236 determines whether or not the safety level register has a value less than or equal to three, indicating that the control is implementing a deceleration or other action, or if the NTS backup system 130 is operating. If so, then the routine ends. If not, then a decision block 238 determines if the velocity is greater than a preselected absolute overspeed, or upper limit, value. If not, then a decision block 240 determines if the difference between the actual velocity and the desired velocity is greater than a preselected trip velocty. If not, then the routine 234 ends. If the velocity is greater than the upper limit, as determined at the decision block 238, or the velocity difference is greater than the trip velocity, as determined at the decision block 240, then the execute safety level routine is implemented, designating code 07 and level 2 at a block 242, and the routine ends.

Thereafter, or if it was determined at the decision block 202 that the car was not running, control continues to a logic block 244. The logic block 244 determines if there is a loss of an inspection direction request. This occurs if during an inspection of the elevator system a service technician removes a command to move the car 12. This error is assigned a code of zero and a level of 2.

Subsequently, or if the safety level is greater than 2, as determined at the decision block 200, above, a decision block 246 determines whether the value in the safety level register is equal to 6, the reset value. In the first pass, and assuming that no previous errors mere sensed, the safety level register value is 6, i.e. a "yes" condition, and the control advances via a node D to a logic block 248, see FIG. 4*c*. The logic block 204 determines if a soft fault has occurred in the motor drive 80. A soft fault may, for example, be related to temperature of the motor drive 80 and is dependent on the signal on the line 91S, see FIG. 2. If a soft fault exists, then the system calls the execute safety level routine designating a code of 08 and a level of 4.

Thereafter, the motor drive 80 is checked at a logic block 206 for a hard fault on the line 90H. A hard fault is a more severe drive fault. If a hard fault exists, then the execute safety level routine is called with a code equal to 09 and a level equal to 1.

Figure 4A:
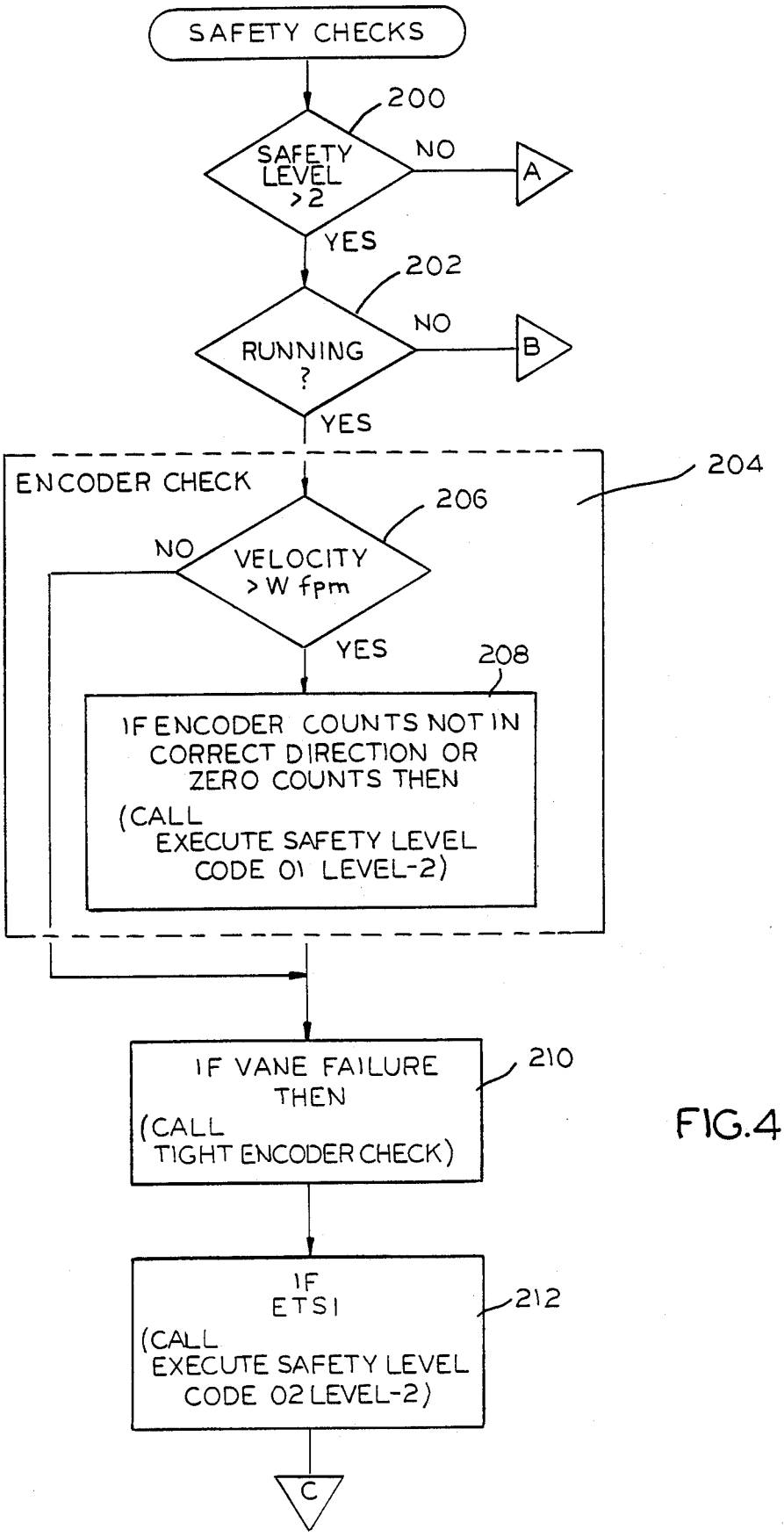
Figure 4B:
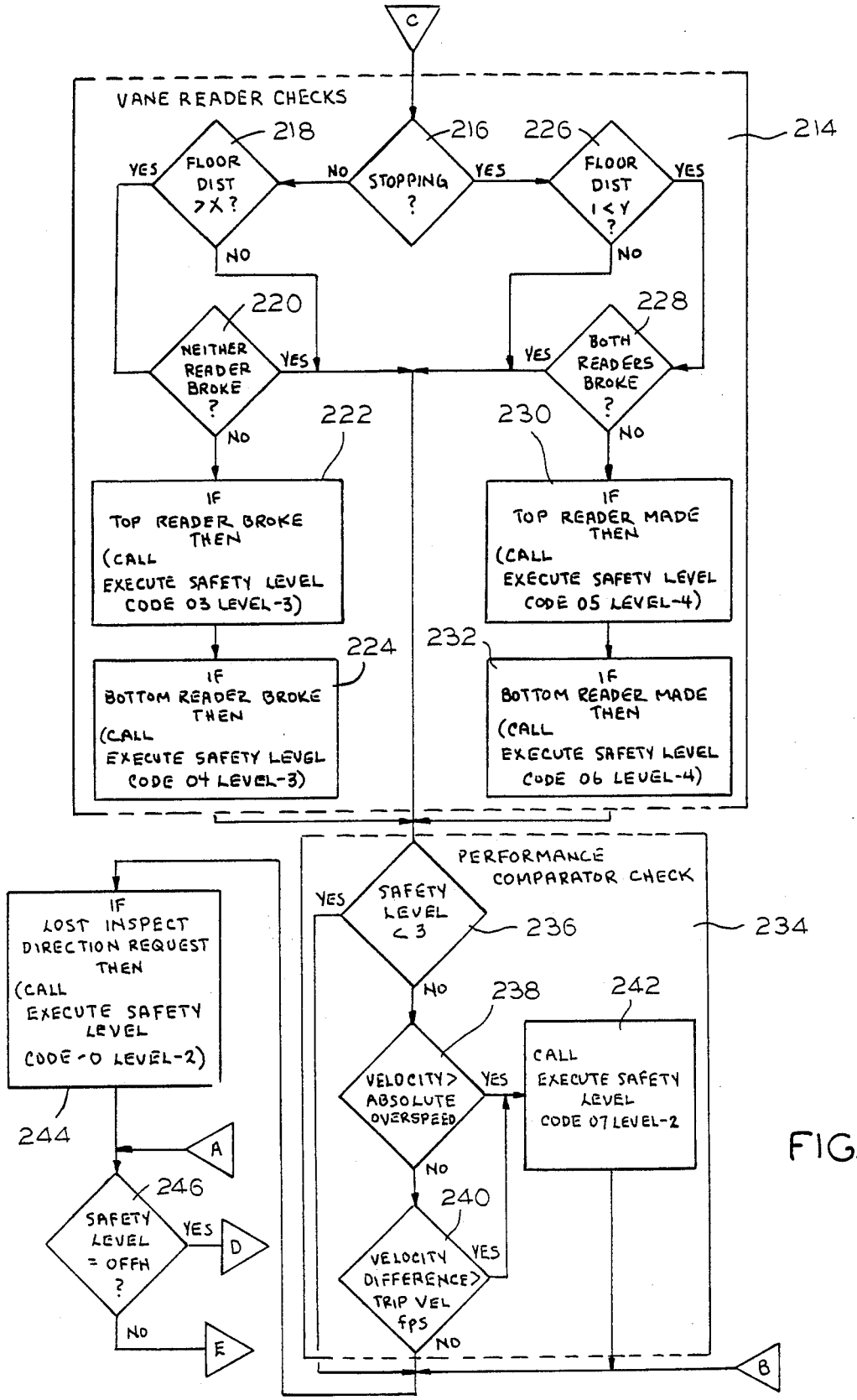
Figure 4C:
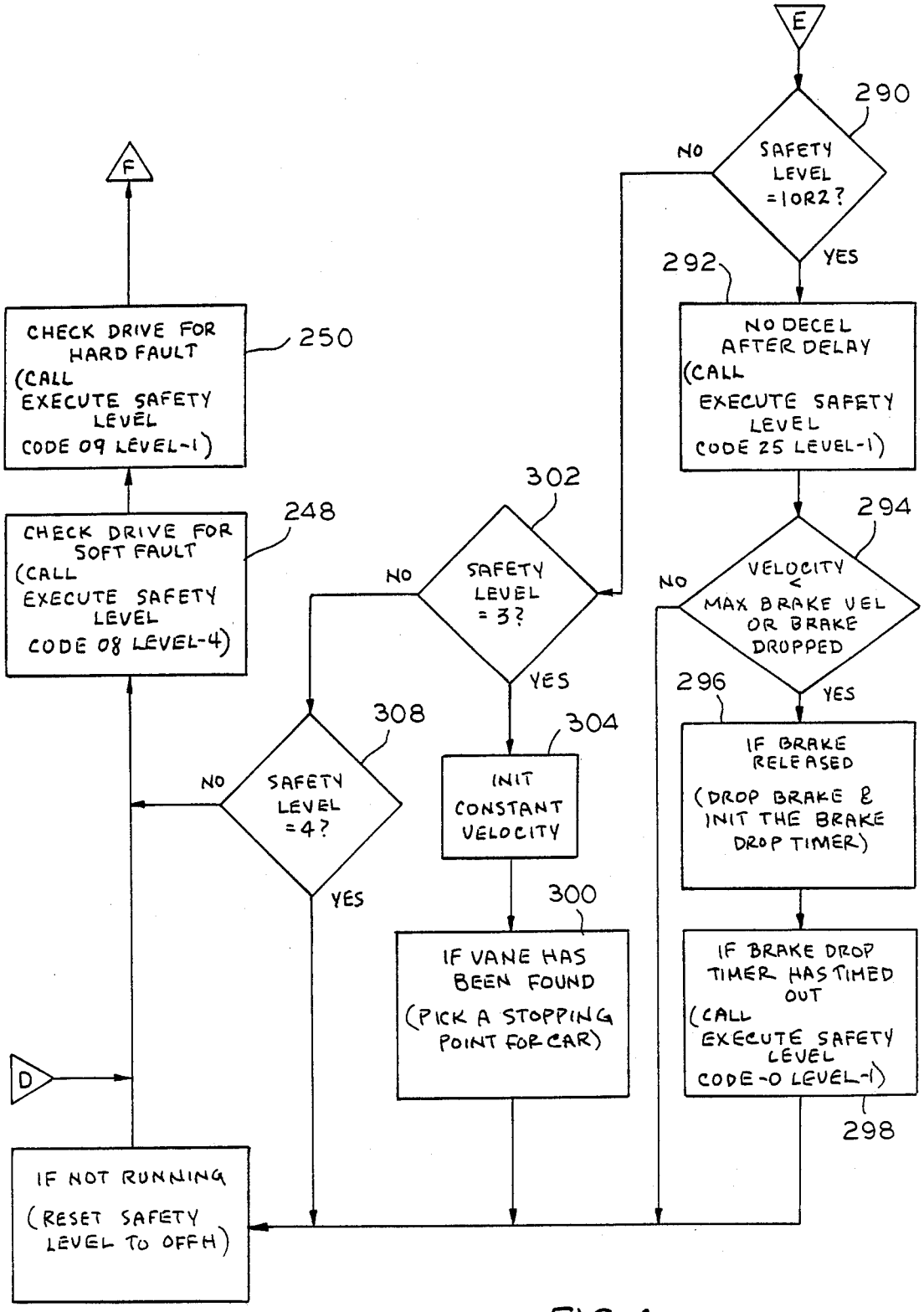
Figure 4D:
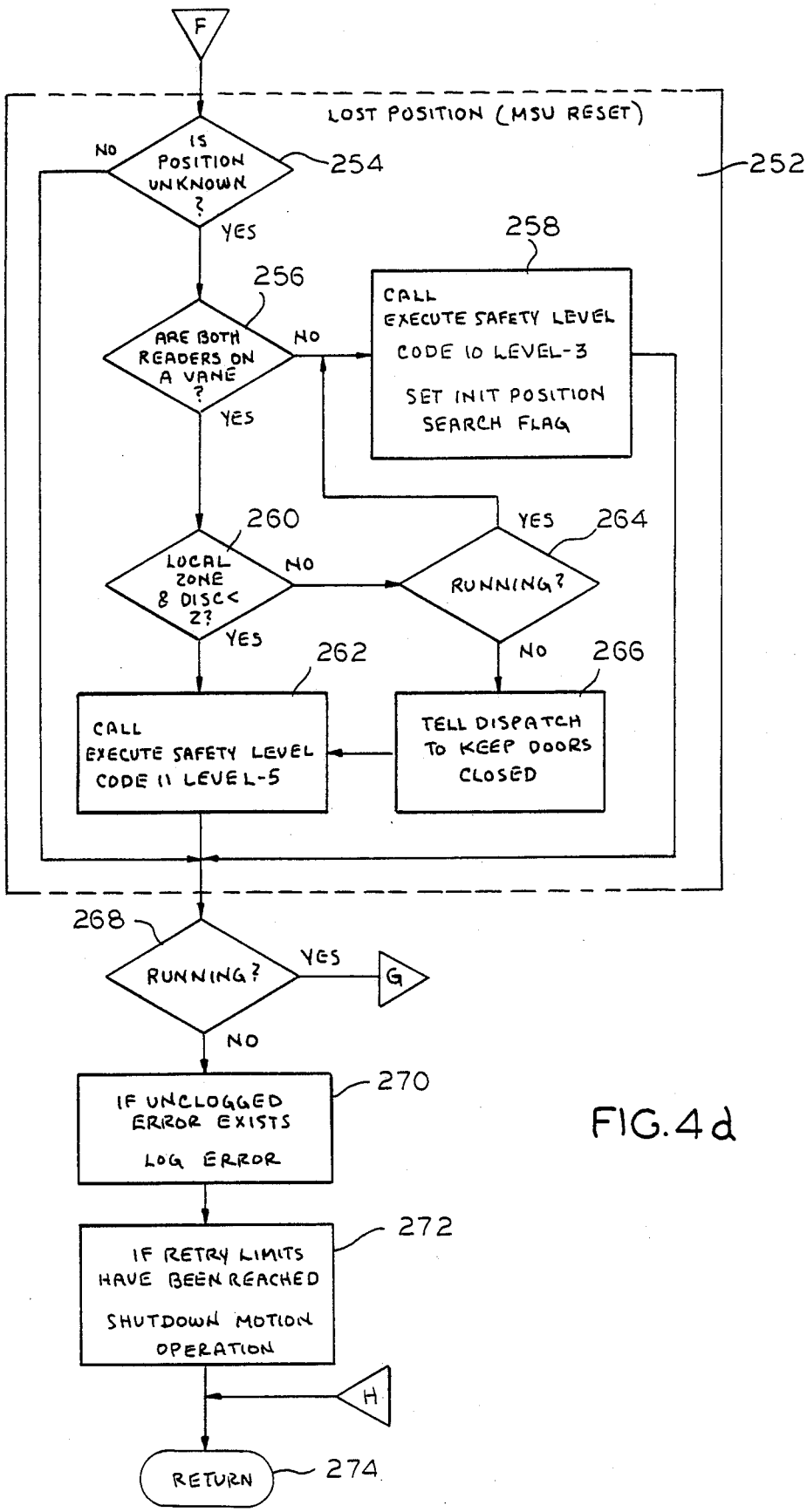
Figure 4E:
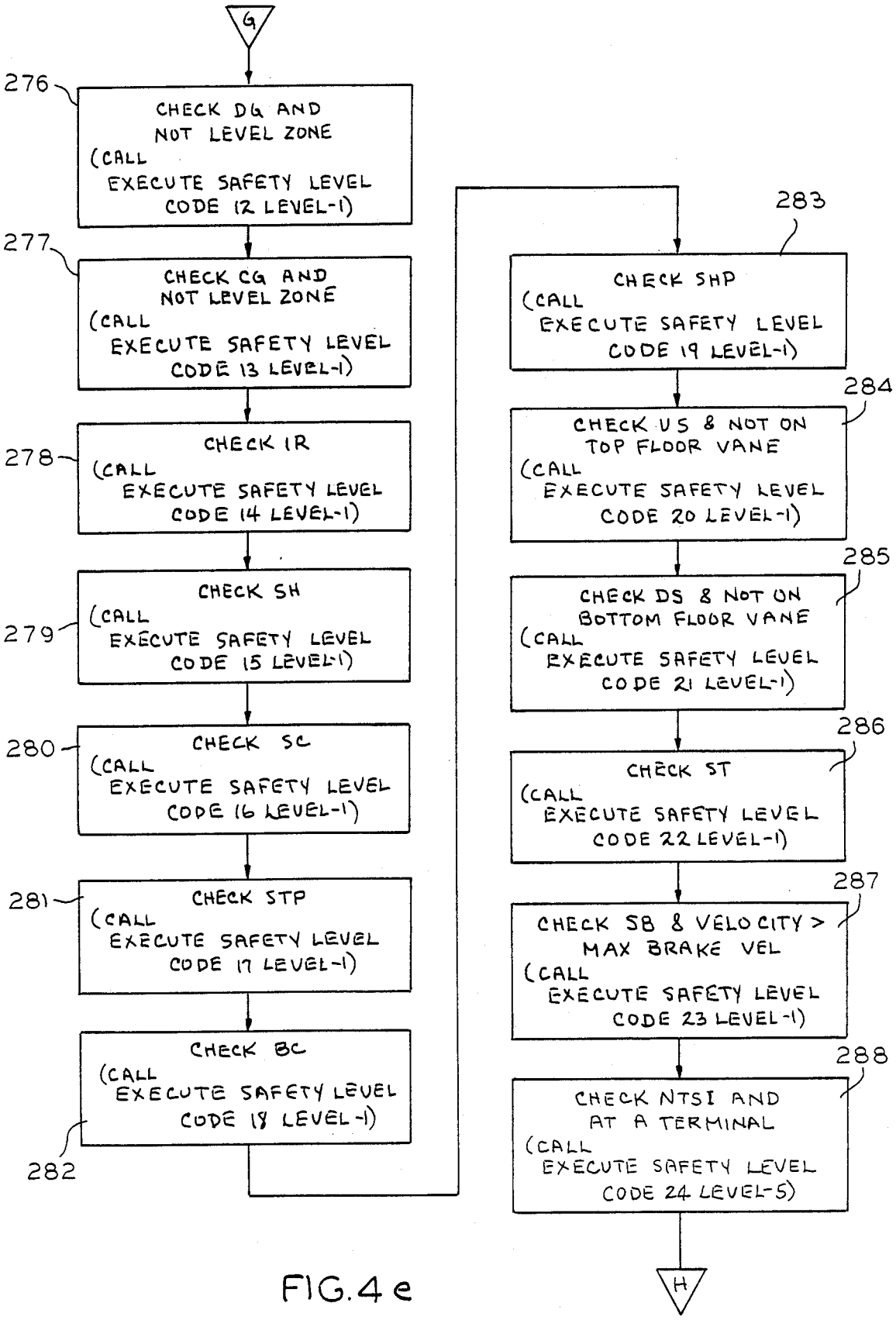

Thereafter, control advances via a node F to a lost position routine 252, see FIG. 4*d*, which is used only when the position of the elevator car 12 is unknown after a reset of the first CPU 50. A decision block 254 determines whether or not the position is unknown. If the position is unknown then a decision block 256 determines if both the upper and lower vane readers 24-U and 24-L, respectively, are reading a vane 26. If not, then at a block 258, the execute safety level routine is called indicating a code of 10 and a level of 3, and an initial position search flag is set. This is done so that the car 12 moves at a slow speed until the motion task correctly updates the position. If both readers 24-U and 24-L are sensing a vane 26, as determined by the decision block 256, then a decision block 260 determines if the car 12 is within the leveling zone and at a distance less than a preselected minimum distance Z from the landing 18. If so, then at a block 262, the execute safety level routine is called indicating a code of 11 and level 5. This is done to log the error and the diagnostic system takes no further action. Particularly, if the car 12 is within Z inches of any landing 18, then the position can be determined according to the vane 26 so that absolute positioning can again be determined by the motion task responsive to the signal from the encoder 40 for subsequent movement of the car 12. Thereafter, the routine ends. If the car 12 is not in the leveling zone, or within Z inches of any landing 18, as determined at the decision block 260, then a decision block 264 determines whether or not the car is running. If so, then control advances to the block 258. If the car is not running, then an instruction is sent to keep the doors closed at a block 266 and control advances to the block 262, as discussed immediately above.

After the lost position routine 252 ends, a decision block 268 determines if the car 12 is running. If the car is not running, then a logic block 270 determines if any unlogged errors exist, and if so logs the error. Subsequently, at a logic block 272, it is determined if any retry limits have been reached, as discussed below. If so, a command is sent to the motion control task to shutdown operation. Otherwise, control advances to a return block 274 and the safety check task ends.

If it is determined at the decision block 268 that the elevator car 12 is running, then control advances via a node G to a series of logic blocks 276–288 having logic functions which are serially performed to determine if any error status exists as determined by the safety string and other input devices connected through the relay interface board 90. If any particular error status exists, then the execute safety level routine is called, designating a predefined error code and action level. Therefore, for simplicity, while discussing each logic block 276–288, the execute safety level routine will not be referred to, other than relative to an indication as to the predefined code and level.

The logic block 276 is responsive to the status at the DG input, see FIG. 3, and whether or not the elevator car 12 is running. Specifically, this logic block determines if any contact between the SS output terminal and the DG input terminal is opened while the car is outside of a leveling zone. The leveling zone is defined as an area proximate the landing 18 when the car 12 is leveling to or at a stop position. If so, then this error is assigned a code 12 and action level 1. The logic block 277 is responsive to the CG input, see FIG. 3, and is true if the car door contact 116 is opened while the car is outside of the leveling zone. This error is assigned a code of 13 and a level of 1.

The logic block 278 determines if the IR relay 120 is open. The IR relay is an inspection relay which indicates that a service technician on top of the car is performing a service routine. This error is assigned a code of 14 and a level of 1.

The logic block 279 is responsive to the SH terminal and determines if any of the contacts in the safety string between the terminals SS and SH, see FIG. 3, are opened. This error is assigned a code of 15 and a level of 1. The logic block 280 monitors the safety string between the terminals SH and SC to determine if any contact therebetween has opened. In actuality, the logic block 280 monitors the logic status at the terminal SC which senses the condition of the string between the terminals SS and SC. However, since the string between the terminals SS and SH has already been monitored at the logic block 279, then it can be assumed that any error sensed at the logic block 280 relates to the string between the terminals SH and SC. If so, then an error code of 16 and a level of 1 is assigned. The logic block 281 detects the safety string from the terminal SC to the terminal STP, and assigns a code of 17 and a level of 1.

The logic block 282 determines if the balance complete relay 122 drops out while the car 12 is moving. This indicates an out of sequence operation. This error is assigned a code of 18 and a level of 1. The logic block 283 is responsive to the signal at the SHP terminal and determines whether or not the motor contactor for driving the motor 32 drops out, causing the auxiliary contact to open, while the car is moving. This error is assigned a code of 19 and a level of 1.

The logic blocks 284 and 285 are used respectively for sensing the condition of the respective upstop and downstop relays 124 and 126. The upstop relay should be open when the car is at the top terminal, or landing 18-N, while the downstop relay should be open when the car is at the bottom terminal, or landing 18-1. The logic block 284 is true if the upstop relay 124 is open while the car is running and the vane 26-N is not being sensed, and designates a code of 20 and a level of 1. Similarly, the logic block 285 is true if the downstop relay 126 is open while the car 12 is running and is not reading the lower landing vane 26-1, and designates a code of 21 and a level of 1.

The logic block 286 is responsive to the ST terminal, see FIG. 3, and checks the safety string from the STP terminal to the ST terminal, and designates a code of 22 and a level of 1 if any contact in the string is opened. The logic block 287 is responsive to the SB relay 128 and is used to sense if the brake is set or dropped while the car has a velocity greater than a maximum brake velocity. This is done to ensure that the brake is not set until the speed is slow enough in order to prevent discomfort to passengers. This error results in designating a code of 23 and a level of 1.

The logic block 288 determines if the NTSI relay 130 is operating with the car 12 at a normal terminal stop. The NTS system is provided for backup to enable the car to stop at a terminal, as is well known. This condition designates a code of 24 and level of 5.

After all of the checks in the logic blocks 276–288 are completed, then the safety check task advances via a node H to the return block 274, see FIG. **4*d***, so that other tasks may be performed.

Returning to the decision block 246, see FIG. **4*b*, if the value in the safety level register is not equal to 6, then control advances via a node E to a decision block 290, see FIG. 4*c*. The decision block 290 determines whether or not the safety level register has a value of one or two. If so, then the control unit 30 should be implementing an emergency stop or deceleration to a stop. A logic block 292 then checks to see if there is no deceleration after a preselected delay. This is done to monitor and ensure that the velocity of the car 12 is in fact decreasing, as required. If not, then the execute safety level routine is called indicating a code of 25 and level 1. Subsequently, a decision block 294 determines if the velocity is less than the preselected maximum brake velocity or if the brake has been dropped, i.e., applied. If so, then a logic block 296 determines if the brake is released, and if so, drops the brake and initiates a brake drop timer. The brake drop timer is used to apply power to the motor 32 for a period of time to provide smoother braking action. A logic block 298** subsequently determines if the brake drop timer is timed out, and if so calls the execute safety level routine designating a code of zero and level of 1. This action assumes that the elevator is not running and in effect resets the error code to zero.

Following the logic block 298, or if the condition of the decision block 294 is false, a logic block 300 determines if the car 12 is not running, and if so resets the safety level register to 6 and control continues to the logic block 248, discussed above.

If the safety level register value is not equal to one or two, as determined at the decision block 290, then a decision block 302 determines whether or not the safety level register value is equal to three. If so, then a block 304 commands the motion control task to operate the car 12 at the slower constant speed. A logic block 306 then determines if any vane 26 has been found in order to determine the actual position of the car 12. If a vane 26 has been found, then a stopping point for the car is determined. Control then advances to the logic block 300.

If the safety level register value is not equal to three, as determined at the decision block 286, then a decision block 292 determines if the safety level register value is equal to four. If so, then control advances to the logic block 300. If the safety level register value is not equal to four, then no action is taken and control advances to the logic block 248.

As is apparent from the above, the safety check task is operable to continually monitor the operational status of various elevator components, and upon determining that an error exists in any such component assigns an error code representative thereof and an appropriate response action level indicating a desired safe operating state for such error.

Referring to FIGS. 5a–5d, a flow diagram illustrates the operation of the execute safety level routine, discussed above. The execute safety level routine is operable to command the appropriate response action to bring the elevator system to a safe operating state.

When the execute safety level routine is called at any time during the performance of the safety check task, control begins at a decision block 406 which determines if the error code is zero. If the code is zero, then control advances to a node K, discussed below. If not, then a decision block 408 determines if a "New Cause Flag" is true. Particularly, the new cause flag is set to true by the motion task when the car 12 is moved between an initial floor and a called floor without error. If not true, then a decision block 410 determines if the error was sensed on the same pass as the initial error, indicating that at least two errors were detected during the same execution of the safety check task. If not, then an update cause buffer routine is called at a block 412, and then control continues to a node K, discussed below. The update cause buffer routine is used to buffer the error which is to be logged at a later time with the prevailing condition information, as discussed below. If the errors were sensed on the same pass, as determined at the decision block 410, then the error is flagged to indicate the same at a block 413 and control continues to the block 412 to log the error. Logging an error and the prevailing conditions existing when the error occurred is done to aid a service technician in determining the cause of the error. Also, flagging subsequent errors is done to indicate when multiple errors occur.

If the new cause flag is true, as determined at the decision block 408, then a decision block 414 determines if it is a first pass through this portion of the logic. If true, then at blocks 415 and 416 the prevailing condition information is stored. This includes, among others, present position, target floor, car direction, and operating mode, i.e., acceleration mode, constant speed mode, or deceleration mode. In either case, control continues at a decision block 418 which determines if the current error is the first detection of a vane reader problem, i.e. codes 03–06. If so, then at a block 420 a flag is set so that for subsequent vane errors the result at the block 418 will be false. Also, the vane failure indication is set for use at the block 210, see FIG. 4a, so that a tight encoder check is run, a stop cause register is set equal to the code number, and tight encoder check values, or initial conditions, are reset. This action delays logging of a vane error until a tight encoder check can be run to ensure that the error is in fact due to a vane malfunction rather than an encoder malfunction. Control then advances to the node K.

If it is determined at the decision block 418 that it is not the first detection of a vane reader problem, i.e, the error is a non-vane error or a subsequent vane error, then control advances via a node I to a decision block 422 which determines if the error is not a vane failure or if the vane failure has changed. This is used to monitor if other errors occurred while checking for a vane failure. If not, then a decision block 424 determines if the tight encoder check is complete. If not, then control advances to the node K. If the decision at either decision block 422 or 424 is true, then a decision block 426 determines if any vane error has been sensed during the elevator run. If not, then at a block 428 the stop cause is set to the code number of the error and the update cause buffer routine is called to store the stop cause. In so doing the prevailing condition information set at the blocks 415 and 416 is also recorded. Subsequently, at a block 430 the motion time is stored at which the error occurred, and the new cause flag is reset to false at a block 432. Therefore, in subsequent control cycles the condition at the decision block 408 will be false.

If it is determined at the decision block 426 that there has been a vane error, then a decision block 434 determines if the code is not a vane code or if the tight encoder check is complete. If neither condition is satisfied, then control advances to the node K. Otherwise, a decision block 436 determines if the code is an encoder failure. If the code is an encoder failure, i.e. code 01, then at a block 438 the update cause buffer routine is called to log the encoder error and control continues at a block 440 which resets the new cause flag equal to false.

If the code is not for an encoder error, as determined at the decision block 436, then at a block 442 the error is flagged and the update cause buffer records the stop cause. Particularly, this step is used to log the vane error, the code of which was stored as the stop cause at the block 420 in a previous execution of the task, after the tight encoder check determines that the malfunction is not due to an encoder error. Thereafter, a decision block 444 determines if the error was sensed on the same pass as the initial error, indicating that at least two errors were detected during the same execution of the safety check task. If so, the code is flagged at a block 446. In either case, control advances to a block 448 which updates the cause buffer with the code. The blocks 442–448 are used to log errors which occur in the order they occur within a given execution cycle. Control then advances to the block 440 to reset the new cause flag.

From either the block 432 or the block 440, control advances to a decision block 450 which determines if the particular stop cause has a retry limit. Particularly, associated with each error code is a preselected retry limit representing the number of errors before which the system should shut down. If the particular cause does not have a retry limit, then control advances to the node K. If the code does have a retry limit, then the retry counter for the stop cause is incremented by one at a block 452, and a decision block 454 determines if the retry counter for the particular error is greater than the maximum allowable number. If not, then control advances to the node K. If the retry counter has exceeded the maximum value, then a decision block 456 determines if a technician has logged on using a service tool. If the elevator is in service, it is not necessary to shut down, as the technician is servicing the elevator system. Therefore, if the tool is logged on, then control advances to the node K. If the tool is not logged on, then at a block 458 a retry max register is set to true to provide an indication to the motion control task to shut down the system once the car 12 has come to a complete stop.

Figure 5A:
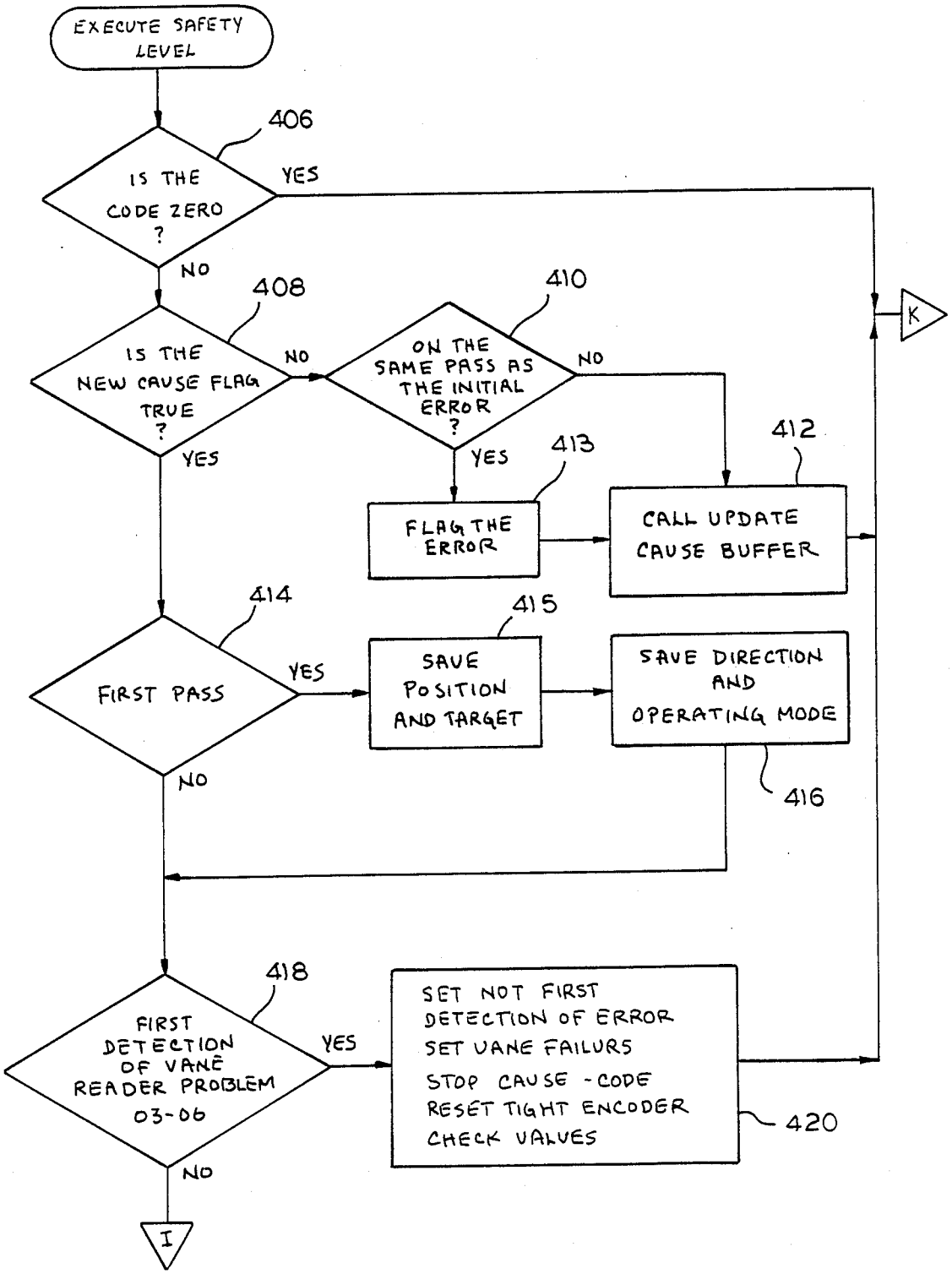
Figure 5B:
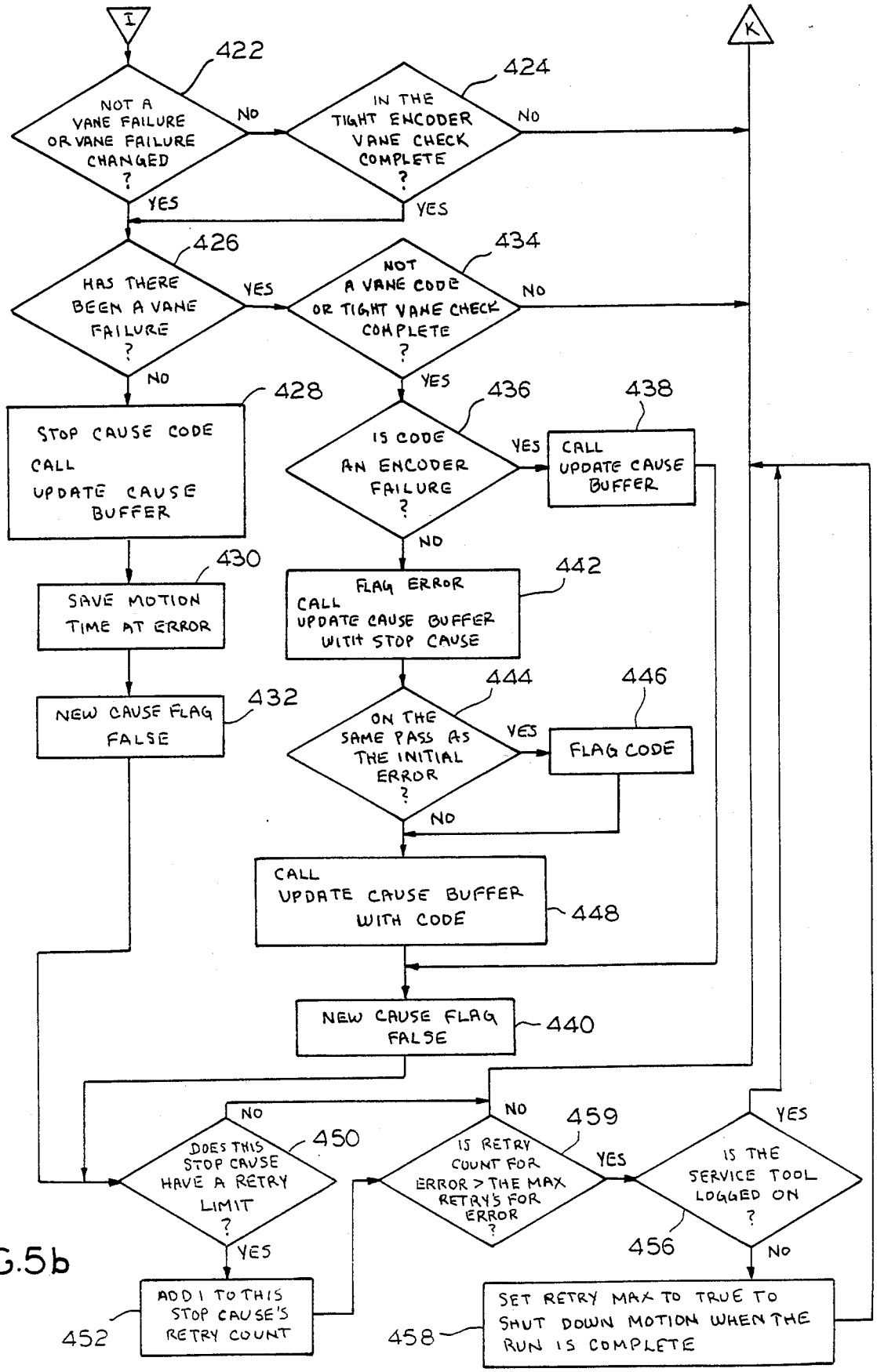
Figure 5C:
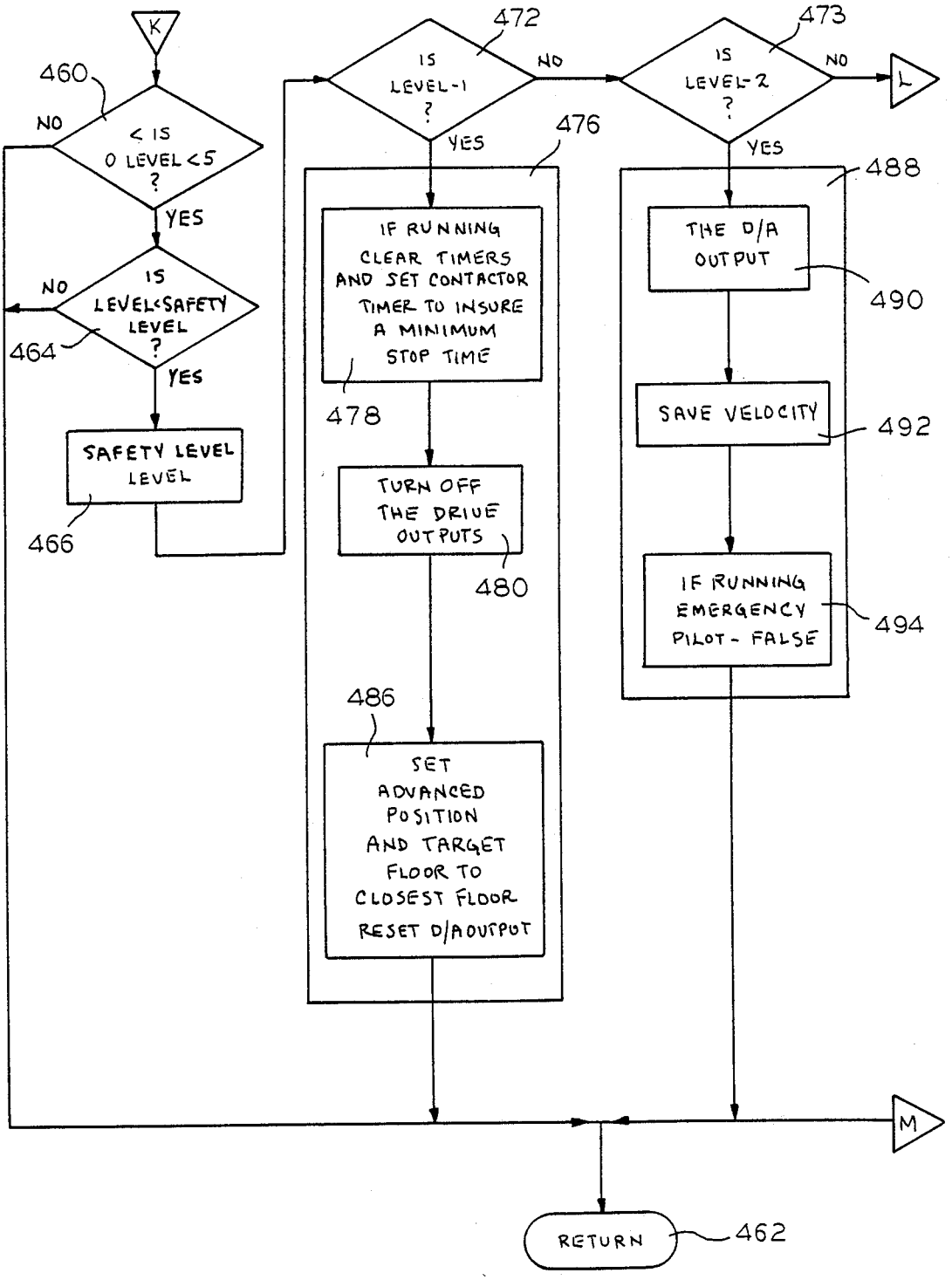
Figure 5D:
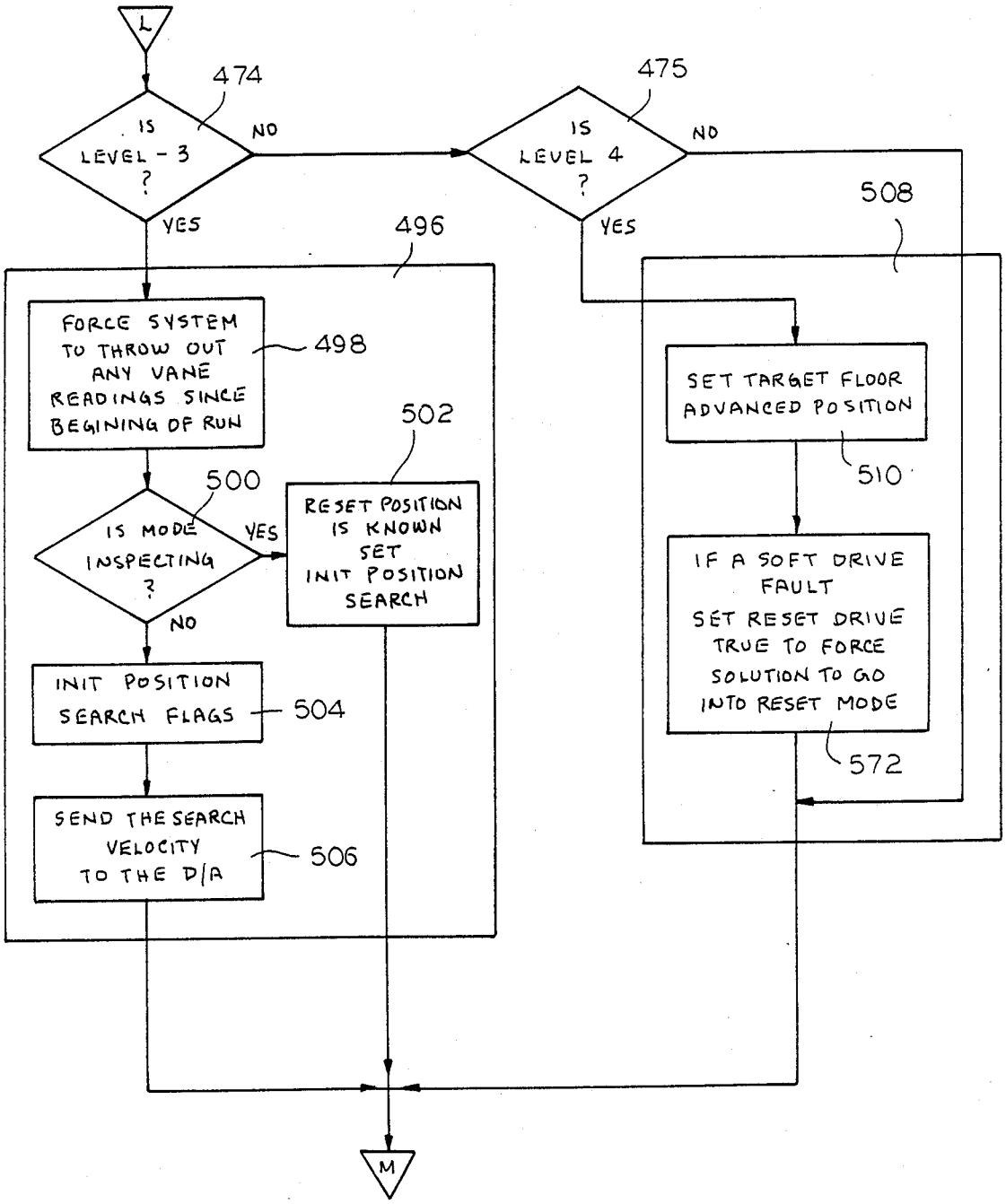

From any of the discussed control blocks which advance to the node K, control continues at a decision block 460, see FIG. 5c, which determines if the level value is greater than zero and less than or equal to five. If not, the routine ends at a return block 462. Otherwise a decision block 464 determines if the level value is less than a value denoted "safety level". The value of safety level represents the lowest action level which has been designated during a particular run of elevator operation. If the level value is less than the safety level value, then at a block 466 the value for safety level is set equal to the value for level. If the level value is not less than the safety level value, then the routine ends. This is done because the lower the value, the more critical the error, and it is only necessary to take action relative to the most critical error.

From the block 466, control advances to a series of decision blocks 472–475 to command the necessary action responsive to the level value to operate the car in a safe operating state. Particularly, action is taken only after the first occurrence of the most critical error.

If the action level is equal to 1, as determined at the decision block 472, then an emergency stop procedure routine 476 is implemented. The emergency stop procedure routine 476 includes a logic block 478 which determines if the car 12 is running and if so clears any run timers, and sets a brake contactor timer to ensure that the car 12 stops for a minimum amount of time. Thereafter, drive outputs, such as the outputs to terminals PA and SBX, see FIG. 3, are turned off at a block 480 to respectively stop the motor 32 and to drop the brake. At a block 486, the system sets a target floor register and an advanced position register so that upon recovery the motion task attempts to operate the car 12 to stop at the closest floor. Also, the velocity D/A command on the line 82, see FIG. 2, representing the desired velocity, is reset to zero. Subsequently, the routine ends at the block 462.

If the error requires an action level 2, as determined at the decision block 473, then an emergency deceleration to a stop routine 488 is implemented. The routine 488 begins at a block 490 which sets the D/A velocity command output on the line 82 to zero so that the motion control task ramps the car to a stop at a constant deceleration rate. At a block 492 the actual velocity is saved. This velocity is used at the block 292 to ensure that the car is decelerating. The logic block 494 then determines if the car 12 is still running and if so sets an emergency pilot flag to false. This flag provides an independent command to the drive 80 to decelerate the motor 32. Thereafter, the routine ends at the block 462.

If the level is determined, at the decision block 474, to be level 3, then a deceleration routine 496 is implemented. This routine is used to decelerate the car 12 to a slower rate of velocity to stop when the car is commanded to change direction. This routine begins at a block 498 which forces the system to ignore any vane readings since the beginning of the run. This is done since most level 3 errors relate to vane malfunctions, and it is assumed that the vane readings are innacurate. A decision block 500 then determines if the elevator is in an inspection mode. If so, then at a block 502 a position-is-known register is reset to false and an initiate position search register is set to true. This commands the motion task to update the position when passing the next vane 26. If the mode is not special, then at a block 504 the initiate position search flag is set to true. At a block 506 a search velocity is sent to the D/A converter 84 and slowdown computation variables are initiated. Resultantly, the elevator car 12 decelerates to a slower speed, continues to the desired floor 18 and then stops and the position information is updated. Thereafter, control advances to the block 462 and the execute safety level routine ends.

If the level is determined at the decision block 475 to be level 4, then a normal stop routine 508 is implemented. This routine 508 is used to provide a normal stop at the next available floor. At a block 510 a target floor register is set to be equal to the next available floor. This commands the motion task to stop the car at the nearest floor according to the current deceleration rate. A logic block 512 then determines if the error is a soft drive fault, discussed above, and if so sets a reset drive register to true so that the motion control goes into a reset mode upon normal completion of the run. This permits the system to attempt recovery at a preselected time, for example 25 seconds, after the stop is achieved. Thereafter, or if the level is not level 4, as determined at the decision block 475, then control advances to the block 462 and the routine ends.

As discussed above, the execute safety level routine is responsible for implementing a preselected action when the routine is called. Specifically, the routine saves the prevailing condition information on the first pass through for display on the service tool. This information is later logged with the error code. However, vane reader errors are not logged until the tight encoder check is completed. If another error occurs during the tight encoder check, then both the initial vane error and the new error are logged. Also, once an error is logged, the retry count for the error is checked to determine if motion should shut down. Also, the preselected action is taken only if the level of a new error is more severe than prior errors during the run.

As described above, the elevator system is operable to monitor errors sensed by various devices and responsive thereto is controllable to take some action to seek to bring the elevator to a safe operating state. Thereafter, the system is operable to analyze the particular error, and the prevailing conditions at the time the error occurred, and attempt some recovery action, if desired.

The types of errors that occur can be classified as one of three types. Namely, the error may be induced by an operator, the error may be a temporary glitch, or the error may be an electrical or a mechanical failure.

An operator induced error may be, for example, the operator throwing a stop switch, or overloading of the elevator car 12. Such errors are subsequently corrected by the operator, as by releasing the stop switch or by removing passengers or freight from the car 12.

The second error type is one that may occur naturally. For example, the vane reader 24 could be obstructed by debris causing the vane reader to trip. A soft fault is a similar type of naturally occurring error. These errors typically are corrected by the passage of time or correction may be facilitated by some other action.

The third error type could result, for example, if a door interlock or landing interlock switch malfunctions or is maintained in an open position. These errors can possibly be corrected by exercising selected elevator operations so that normal operation continues. If the recovery can not be acheived, then the system shuts down.

The recovery action taken depends upon the specific error and its cause. With the first type of error, the error is recorded, as discussed above, and the system is monitored until the operator has corrected the error prior to returning to service. With the second type of error, the system is reset or exercised to determine the extent of the problem with the results of the analysis being recorded. When the problem clears, the system returns to normal service. With the third type of error, the system is exercised to determine the extent of the problem, with the results of the analysis being recorded. If the problem can be corrected, then the system returns to normal service. Otherwise, after a preselected number of retries, if the error is not cleared, then the system shuts down until a service technician can resolve the problem.

The specific recovery action taken depends upon the specific error and the prevailing conditions. The following illustrative examples describe recovery actions attempted for certain types of errors. These examples are simplified by the assumption that no other errors intervene. Specifically, FIGS. 6, 7 and 8 respectively illustrate in flow diagram form the action taken for an encoder check operation, a vane check operation, and a stop switch check operation. Specifically, each of the flow diagram representations describe the overall control performed by the elevator control and motor drive unit 30 including the operation of the motion task, the safety check task, and the execute safety level routine, discussed above. Where appropriate, reference is made to specific portions of the previous flow diagrams discussed above relative to FIGS. 4 and 5.

Referring to FIG. 6, the control action for the encoder check operation is illustrated. This operation begins at a decision block 500 which determines if the encoder 40 is operating acceptably. Particularly, this decision is based on the result of the gross encoder check routine 204, see FIG. 4*a*. If operation is acceptable, then no further action is taken. If the gross encoder check fails, i.e. code 01, then the error is reported at a block 502. This is the logging of the error done at the block 428, see FIG. 5*b*. Thereafter, the number of encoder failures is updated at a block 504. This represents the incrementing of the retry count at the block 452, see FIG. 5*b*. Subsequently, at a decision block 506 it is determined if the number of failures is greater than the maximum limit allowed for an encoder error. If so, then at a block 508 a command is sent to the motion task to search for a terminal stop, stop at the directional stop and shut down car motion. Resultantly, when the car 12 reaches the bottom landing 18-1 or the top landing 18-N, the car stops, the system shuts down operation, and the routine ends.

If the number of failures does not exceed the limit, as determined at the decision block 506, then the constant deceleration to a stop routine 488, see FIG. 5*c*, is initiated at a block 510. Control waits for the car to stop at a decision block 512.

Absolute car position information is determined by the first CPU 50 by counting encoder pulses starting from a known position. Once an encoder error has been sensed, the position information is unreliable. Therefore, a search must be done to update the position information. Also, it is desirable to further test the encoder 40 in case the error has cleared itself. At a block 514, the motion task restarts motion of the car 12 in order to establish its position. Specifically, the motion task may operate the car 12 at a normal speed, or alternatively, at a slower speed, as desired. At a decision block 516, it is determined if any vane 26 is read while the car 12 is in motion. If not, then car movement is continued to a terminal, i.e. the top or bottom landing, while waiting for a good vane reading. Once the car 12 reaches a terminal, the direction of car travel is reversed. A decision block 520 determines if the car 12 has stopped at two terminals. If not, then control returns to the decision block 516. If the car 12 has stopped at two terminals, as determined at the decision block 520, and there has been no vane 26 read in the meantime, then car motion is shut down at a block 522 and the routine ends. This control action is operable to permit the car 12 to traverse one complete trip between the bottom landing 18-1 and the top landing 18-N while attempting to read a vane 26.

If any vane 26 is read during this test period, as determined at the decision block 516, then the result of the gross encoder check routine 204 is monitored at a decision block 524. If the encoder operation is acceptable, then the car position information is updated from the vane 26 read at the decision block 516 and control returns to the beginning of the operation at the decision block 500. As should be appreciated, the car may then continue under normal operating conditions.

If the encoder operation is not acceptable, as determined at the decision block 524, then the number of failures is updated at a block 528, and a decision block 530 determines if the number of failures is greater than the limit. If not, then control returns to the block 510. If the number of failures is greater than the limit, then the system shuts down at a block 532, similar to the block 508, above, and the routine ends.

Thus, the encoder check operation after stopping movement of the car 12, attempts to recover by restarting the car, completing a position search, and performing subsequent tests on the encoder 40 to determine if it is operational. This test may be performed, for example, three times prior to commanding a complete shutdown.

Referring to FIG. 7, a flow diagram illustrates the operation for resolving vane reader errors. The operation begins at a decision block 600 which determines whether or not the vane readers 24 are operational. The result of this decision is determined by the vane reader check routine 214, see FIG. 4*b*. If the readers 24 are operational, then no further action is taken. If any vane reader error occurs, then at a block 602 the system initiates the deceleration to a slow speed routine 496, see FIG. 5*d*, and also initiates the tight encoder check. Specifically, the tight encoder is initiated at the block 420, see FIG. 5*a*, and is actually performed at the logic block 210, see FIG. 4*a*. Control waits at the block 604 for the tight encoder check to be completed.

Once the tight encoder check is completed, then a decision block 606 determines if there has been an encoder failure, as determined at the decision block 436, see FIG. 5*b* above. If so, then at a block 608, the encoder error is logged. Otherwise, the original vane error is logged at a block 610. The control operates in this manner because in certain instances what is initially determined to be a vane error is in actuality an encoder error. As discussed above, absolute position is determined according to information obtained by the encoder 40. If the encoder 40 is malfunctioning, or is providing incorrect information, due to slippage of cables and the like, the absolute position information will be incorrect. Thus, when the vane reader check routine 214 is performed, the actual position of the car 12 will be different from the sensed position as determined by the encoder information. This causes a vane reader error to be sensed when, instead, there is an encoder error or the the position information needs to be updated.

Therefore, it is subsequently necessary to determine if there is an encoder error or a vane error, and then take appropriate action. However, first a position search must be done to determine the actual position of the car 12.

At a decision block 612, control determines if any vane 26 is read. If not, then control blocks 614, 616, and 618, similar to the respective blocks 518, 520, and 522 of FIG. 6, allow the car to traverse one complete passage in the hoistway to obtain a position reading. If no vane 26 is read, then car motion shuts down at the block 618, and the routine ends.

If a vane 26 is read, as determined at the decision block 612, then a decision block 620 determines if the encoder is acceptable, as determined by the tight encoder check routine 210, see FIG. 4*a*. If so, then the position information is updated at a block 622, and at a block 624, the retry count for the particular vane error is updated. A decision block 626 determines if the number of failures is greater than the limit for the particular error. If not, then control returns to the decision block 600 to resume normal action. If the number of failures is greater than the limit, then control advances to a block 628, similar to the block 508, see FIG. 6, to shut down operation and the routine ends.

If it is determined at the decision block 620 that the encoder 40 is not acceptable, then at a block 630 the number of failures of the encoder 40 is updated. Thereafter, a decision block 632 determines if the number of failures is greater than the limit. If so, then control continues to the block 628 to shut down operation. Otherwise, control returns to the decision block 600 to resume normal operation.

Thus, the vane check operation upon sensing a vane error operates the car 12 at a slower speed and after ascertaining the correct position of the car attempts to determine if the error is a vane error or an encoder error and to shut down operation if either error continues. As is apparent from the above, there is some overlap between the vane check operation and the encoder check operation.

Referring to FIG. 8, a flow diagram illustrates operation of a stop switch check operation. This operation begins at a decision block 700 which determines if the stop switch is in the run position. If so, then no further action is taken. Particularly, the stop switch is an input from the block 112, see FIG. 3, to the STP terminal. The actual test is performed at the logic block 281, see FIG. 4*e*.

If the stop switch is not in the run position, i.e. an operator has commanded a stop, then at a block 702 an emergency stop is initiated, as by implementing the emergency stop routine 476, see FIG. 5*c*. Also, the code is logged at a block 704. Movement of the car is monitored at a bock 706 and a decision block 708 is operable to wait until the car has come to a complete stop.

Thereafter, a decision block 710 determines if the stop switch is in the run position. If not, then no further action is taken, and car movement is prevented. If the stop switch is returned to a run position, then a block 712 determines if there is a retry limit for the particular error. For a stop switch, there is no limit so that once the stop switch is returned to the run position, car motion is allowed to restart at a block 714, and then control returns to the decision block 700, above.

Thus, the stop switch check operation is operable to stop movement of the car 12 in the event that the stop switch is not in the run position, and to maintain the car in the stop position until the switch is returned to the run position.

The flow chart of FIG. 8 can be used for other similar type errors. The flow chart could be changed, as necessary, or desired, by implementing a shutdown routine if a preselected retry limit is utilized, as discussed above.

As is apparent from the above, in operation, the safety check task periodically monitors any errors which occur as sensed by the various I/O devices. Responsive thereto, the particular error is logged, and the execute safety level routine takes suitable action, depending upon the severity of the error, to move the car 12 to a safe operating state. Such action ranges from stopping the elevator at the next elevator floor to an emergency stop which stops the elevator car immediately. Subsequently, the cause of the error is analyzed and a recovery action is taken. The particular recovery action is dependent upon the specific error and its cause.

The logging of the errors is done so that a service technician can more quickly discover the source of any errors by knowing the particular error, and the prevailing conditions which existed at the time the error occurred.

We claim:

1. In an elevator control system operable to control movement of an elevator car in a hoistway, a diagnostic system comprising:

means for sensing the operative status of a plurality of preselected elevator operational characteristics, each said operational characteristics having a preselected error level;

means coupled to said sensing means for monitoring the operative status of such characteristics to determine if any of said operational characteristics are in a preselected error status; and means responsive to said monitoring means for operating said control system to implement a desired action according to the error level of any operational characteristic which is in an error status as determined by said monitoring means.

2. The diagnostic system of claim 1 wherein said operating means includes means for stopping movement of the elevator car, means for continuing movement of the elevator car, and means for commanding operation of said stopping means or said continuing means according to the error level of any opertional characteristic which is in an error status.

3. The diagnostic system of claim 2 wherein said stopping means includes means for selectively stopping movement of the elevator car at a preselected position in the hoistway, at a preselected rate, or virtually immediately according to the error level of any opertional characteristic which is in an error status when commanded to by said commanding means.

4. The diagnostic system of claim 2 wherein said continuing means includes means for selectively operating said car at a preselected normal speed or a preselected slower than normal speed according to the error level of any opertional characteristic which is in an error status when commanded to by said commanding means.

5. The diagnostic system of claim 1 further comprising means responsive to said monitoring means for logging elevator operational characteristics which are in an error status.

6. The diagnostic system of claim 5 wherein said logging means includes means for storing information relative to a plurality of preselected elevator operational characteristics at the time any operational characteristic is in an error status.

7. A method of diagnosing errors which occur in the operation of an elevator control system operable to control movement of an elevator car in a hoistway, comprising the steps of:

assigning a preselected error level to each of a plurality of preselected elevator operational characteristics;

sensing the operative status of said plurality of preselected elevator operational characteristics, said status comprising either a normal status or an error status;

determining if any of said operational characteristics are in the error status as sensed at said sensing step;

implementing operation of said elevator control system to take a preselected action responsive to any elevator operational characteristic being in an error status as determined at said determining step to bring said car to a safe operating state; and continually repeating the last three mentioned steps to provide a self-diagnosing elevator control system.

8. The method of claim 7 further comprising the step of logging any operational characteristic which is in an error status as determined at said determining step.

9. The method of claim 7 further comprising the step of attempting to continue elevator operation subsequent to taking the preselected action at said implementing step.

10. The metod of claim 7 wherein said implementing step includes the step of commanding the elevator control system to stop movement of the elevator car or continue movement of the elevator car according to the error level of any opertional characteristic which is in an error status.

11. The method of claim 10 wherein said commanding step includes the step of selectively stopping movement of the elevator car at a preselected position in the hoistway, at a preselected rate, or virtually immediately according to the error level of any opertional characteristic which is in an error status when commanded to at said commanding step

12. The method of claim 10 wherein said commanding step includes the step of selectively continuing movement of the elevator car at a preselected normal speed or a preselected slower than normal speed according to the error level of any opertional characteristic which is in an error status when commanded at said commanding step.

13. A self-diagnosing elevator control system operable to command movement of an elevator car in a hoistway, comprising:

drive means for controlling movement of said elevator car in said hoistway;

means for sensing the status of a plurality of preselected elevator operational characteristics, each said characteristic having a preselected error level;

means responsive to said sensing means for controlling operation of said drive means to control movement of said elevator car in said hoistway, said controlling means including:

means coupled to said sensing means for monitoring the operative status of said operational characteristics to determine if any of such operational characteristics are in an error status;

means responsive to said monitoring means for commanding said control means to effect preselected movement of said elevator car responsive to the error level of any operational characteristic which is in an error status; and means for logging each occurrence of any operational characteristic being in the error status.

* * * * *